US006255956B1

(12) United States Patent
Tingley et al.

(10) Patent No.: US 6,255,956 B1
(45) Date of Patent: Jul. 3, 2001

(54) SEAT OPERATED SWITCH AND WARNING SYSTEM

(76) Inventors: Gloria J. Tingley; Arlyne A Secondo, both of 941 Barlett Pl., Windsor, CA (US) 95492

( * ) Notice: Subject to any disclaimer, the term of this patent is extended or adjusted under 35 U.S.C. 154(b) by 0 days.

(21) Appl. No.: 09/384,661

(22) Filed: Aug. 27, 1999

(51) Int. Cl.[7] ..... G08B 21/00

(52) U.S. Cl. ..... 340/667; 340/573.1; 340/573.7; 340/626; 340/573; 340/666

(58) Field of Search ..... 340/667, 573.4, 340/573.1, 573.7, 555, 556, 626, 666, 573

(56) References Cited

U.S. PATENT DOCUMENTS

| | | | | |
|---|---|---|---|---|
| 4,242,672 | * | 12/1980 | Gault | 340/573 |
| 5,140,309 | * | 8/1992 | Gusakov | 340/573 |
| 5,473,313 | * | 12/1995 | Graebe, Jr. | 340/626 |
| 5,600,305 | * | 2/1997 | Stafford et al. | 340/573 |
| 5,808,552 | * | 9/1998 | Wiley et al. | 340/573 |
| 5,945,914 | * | 8/1999 | Holmes et al. | 340/667 |
| 5,990,799 | * | 11/1999 | Boon et al. | 340/667 |
| 6,043,747 | * | 3/2000 | Altenhofen | 340/573.1 |
| 6,049,281 | * | 4/2000 | Osterweil | 340/573.4 |

* cited by examiner

*Primary Examiner*—Jeffery Hofsass
*Assistant Examiner*—Huang Nguyen
(74) *Attorney, Agent, or Firm*—Risto A. Rinne, Jr.

(57) ABSTRACT

Seat Operated Switch and Warning System with an air cushion, an air tube leading from the air cushion to an air pressure switch, an electronic circuit to activate devices when a reduction in air pressure is sensed, a digital recordable message device, a radio frequency transmitting device, a housing to contain the pressure switch, digital message device and transmitting device, a matching radio frequency receiving device, and a portable housing to contain said receiving device said housing also containing an audio transducer that creates an audible warning sound activated by said receiving device. A preferred embodiment includes wherein when a person sits on said air cushion the pressure caused by the weight of the person causes said air pressure switch not to activate, but when said person exits off of said air cushion said air pressure switch causes said recorded message to play and causes said transmitter to send a signal to said receiver causing said audio transducer to produce a warning sound.

6 Claims, 3 Drawing Sheets

SEAT OPERATED SWITCH AND WARNING SYSTEM

BACKGROUND OF THE INVENTION

This invention relates generally to the field of warning devices, and more particularly to a seat operated switch and warning system.

In recent years the number of people who are diagnosed with Alzheimers Disease has increased considerably. This is due in part because there are a greater number of elderly people living today than ever before. The care of Alzheimer patients can be difficult in that there short term memory is impaired and therefore patients can easily forget instructions given to them. If left unattended, an Alzheimer patient may wander away and then find him or herself in a state of panic and confusion when they fail to recognize where they are. For this reason Alzheimer care givers need to keep a constant eye on their pateints. Unfortunately, care givers frequently have other chores to do or have a number of patients to care for making it difficult to keep a constant watch on each patient. One way to solve this problem is to restrain the patient in some way, however this is obviously an unsatisfactory solution in that the lack of freedom of movement is regarded as inhumane. There is therefore a need to alert Alzheimer care givers as to if and when an Alzheimer patient leaves his or her seat or bed. To this end it would be helpful to have a device that creates a warning sound when a person leaves his or her seat or bed.

Various types of seat operated switches are known including those found in current model vehicles that alert a person to attach his or her seat belt. However these mechanical switch based warning devices are built into the underside of the seat and are not removable or replaceable. They also do not transmit a signal to a remote location where a person some distance away can be alerted to the fact that someone is or is not in a seat.

Additionally, the mechanical switch based warning system can be defeated if the person in the seat sits on one edge of the seat and might not activate the switch. Finally, existing seat operated warning systems do not have the option of having a custom recorded message play when a person leaves the seat.

SUMMARY OF THE INVENTION

The primary object of the invention is a seat operated switch and warning system that monitors whether or not a person is sitting on a chair or the like.

Another object of the invention is a seat operated switch and warning system that operates by changes in air pressure.

Another object of the invention is a seat operated switch and warning system that transmits an audible alert to an attendant if a person leaves his or her seat.

A further object of the invention is a seat operated switch and warning system that emits a recordable message when a person leaves his or her seat.

Other objects and advantages of the present invention will become apparent from the following descriptions, taken in connection with the accompanying drawings, wherein, by way of illustration and example, an embodiment of the present invention is disclosed.

A seat operated switch and warning system comprising: an inflatable air cushion, an air tube leading from said air cushion to an air pressure switch, an electronic circuit to activate devices when a reduction in air pressure is sensed, a digital recordable message device, a radio frequency transmitting device, a housing to contain said pressure switch, digital message device and transmitting device, a matching radio frequency receiving device, and a housing to contain said receiving device said housing also containing an audio transducer that creates an audible warning sound activated by said receiving device.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
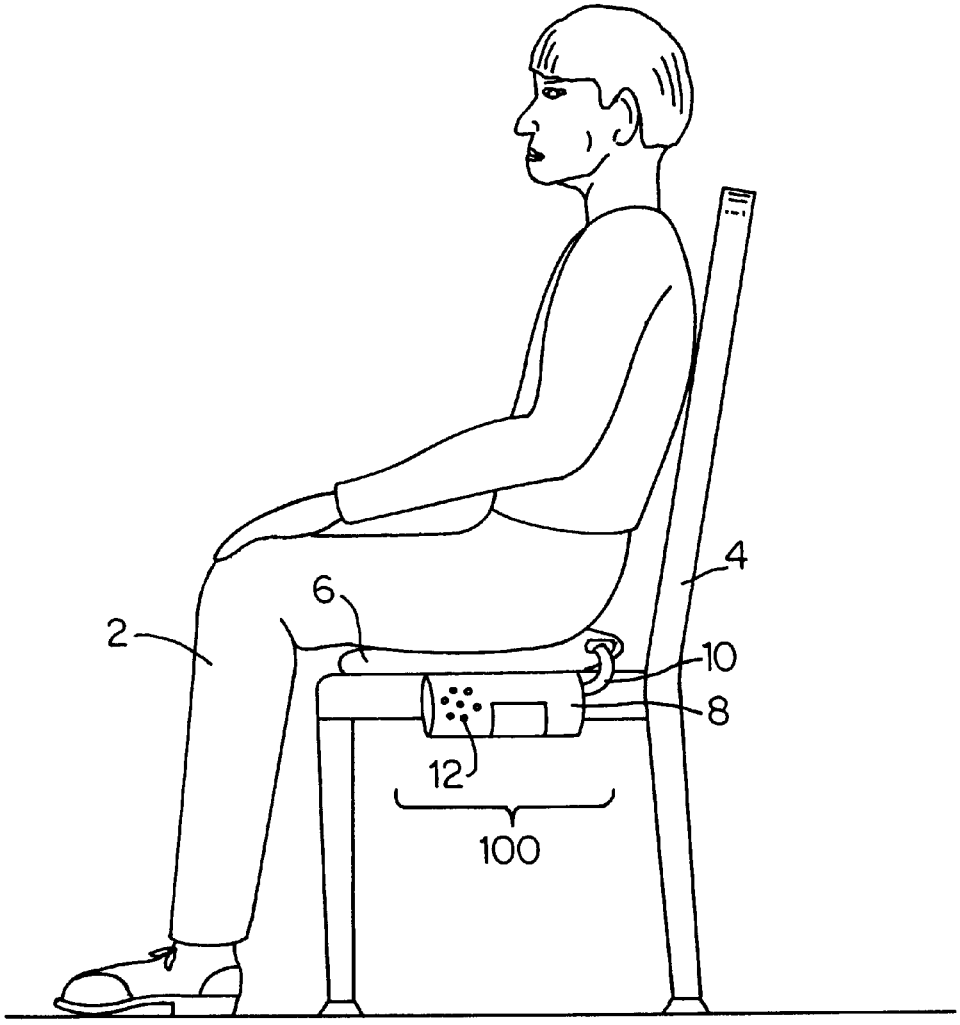
FIG. 1 is a side view of a person sitting on a chair incorporating the seat operated switch warning system of the present invention.
Figure 3:
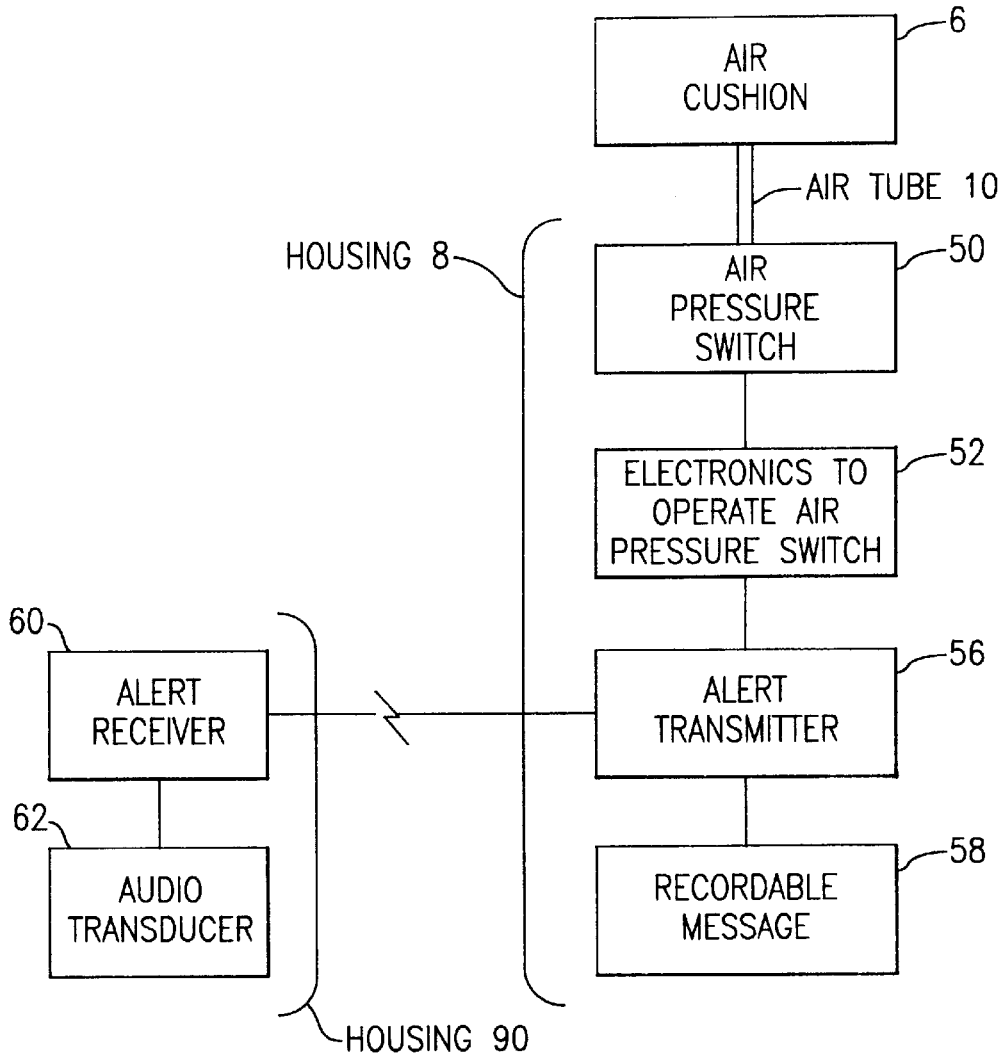
FIG. 3 is a block diagram of the present invention

Referring now to FIG. 1 we see a side view of a person 2 sitting in a chair 4 and having the inflatable air cushion 6 of the present invention 100 in place between the seat top and the users bottom. An air tube 10 connects the cushion 6 with an air pressure switch 50 located in housing 8. The air cushion of the present invention is relatively thin in profile and does not adversely affect the seated height of the patient. The air cushion is comfortable and can fold own to a compact size when deflated. The air cushion is ideal in that no matter where the patient sits on the cushion, the increase or decrease in air pressure is instantly transmitted to the pressure switch. Whereas a mechanical switch may prove unreliable in that if a patient sits on one corner of the cushion it may not activate the switch. FIG. 3 shows a block diagram of the elements of the invention. Inflatable air cushion 6 has an air tube 10 extending from it to a pressure sensing device 50. When the user 2 exits from the chair 4 the drop in air pressure is communicated through the pressure sensing device 50 to an electronic circuit 52 that in turn activates a transmitter 56 and a recordable message device 58. The message can be customized for the person sitting in the chair. For example if the persons name is Susan, the message could say "Susan, please sit down". The message could be repeated multiple times to reinforce the statement. The transmitter 56 sends a signal to a receiver 60 that is contained in a housing 90 and warn by a care giver in a similar way that a eager is warn, that is clipped onto a belt or the like. The receiver then triggers an audible warning sound preferably produced by an audio transducer 62 and associated driving circuit and power supply. The transmitter 56, digital message recorder and playback device 58 and receiver 60 are all devices that are well within the known art and in the public domain, therefore further description of them is not necessary. It is the unique combination of these elements when coupled with an air cushion and pressure switch that make the present invention unique.

Figure 2:
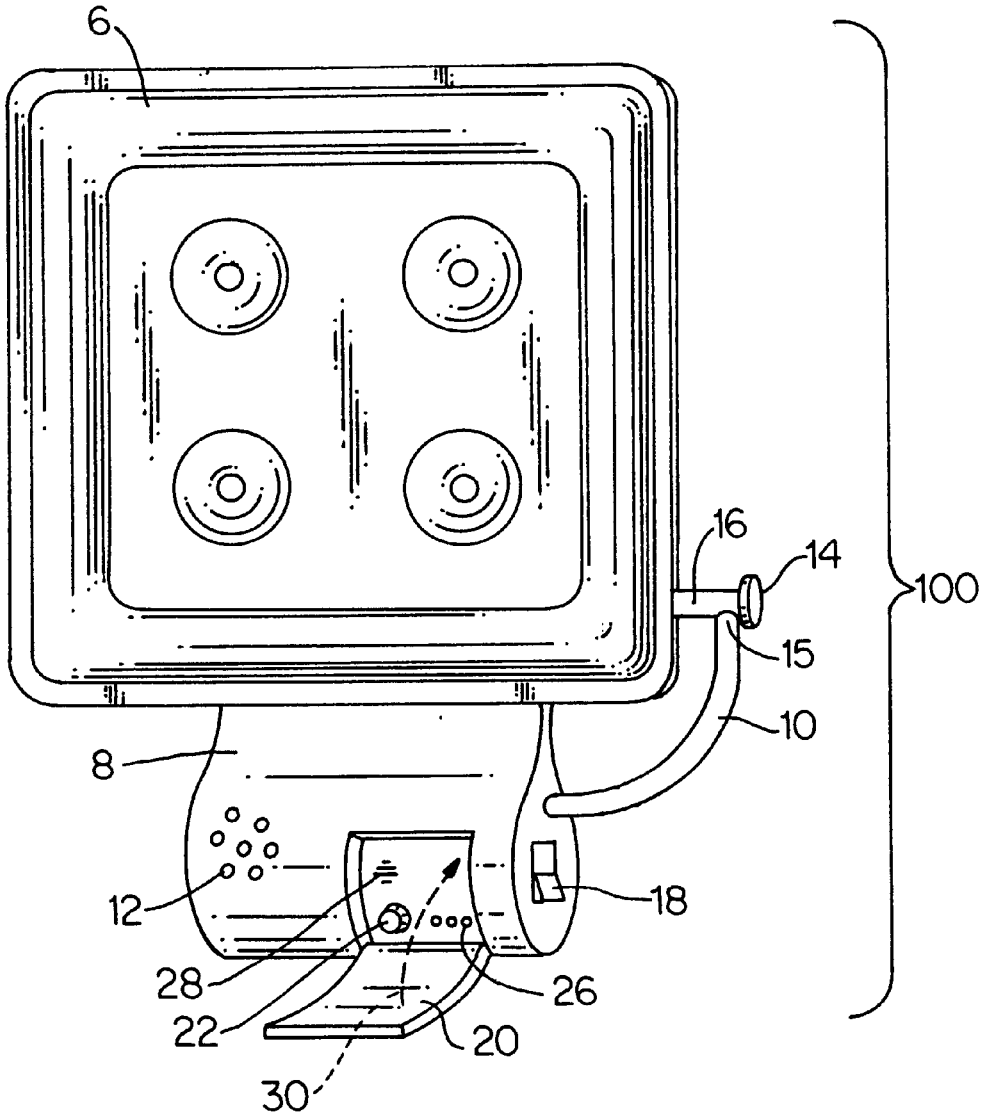
FIG. 2 is a plan view of the present invention.

FIG. 2 shows a plan view of the present invention 100. Air cushion 6 is roughly square in shape and made of inflatable vinyl. The vinyl can be flocked or covered with a cloth cover to promote proper air circulation between the cushion and the user. Air valve 16 has a removable and replaceable closure 14 for inflation and deflation purposes. A Tee fitting 15 joins air tube 10 to valve 16. Air is carried through tube 10 into housing 8 where it joins with pressure sensing device 50 as described and illustrated above. Housing 8 is preferably thin in cross section so that in some cases it may by slid, along with cushion 6, underneath an existing seat cushion on a sofa or chair or underneath the mattress of a bed. switch 18 activates and deactivates the electronics inside housing 8. Speaker allow the digital message to be heard clearly. Door 20 is normally closed but is shown now in the open 30 position which exposes record button 22 and microphone 28. LED's 26 light up during recording and sequentially turn off to indicate recording time remaining. Housing 8 is shown attached to cushion 6 however housing 8 could also be separate from cushion 6 and attached only by air tube 10.

In the above described and illustrated way the present invention can provide a care giver for an Alzheimer patient a way to easily verify the fact that the patient is still on the chair or bed to which the patient has been placed by the care giver. The device of the present invention also helps remind the patient to stay seated by sounding a pre recorded message if and when the patient decides to leave his or her chair. It is obvious and within the scope of this patent that the present device can be used for other similar purposes such as insuring that a child, or prisoner or even a pet stays seated in a particular location.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A seat operated switch and warning system comprising:

(a) an air cushion;

(b) an air tube leading from said air cushion to an air pressure switch;

(c) an electronic circuit to activate devices when a reduction in air pressure is sensed;

(d) a digital recordable message device;

(e) a radio frequency transmitting device;

(f) a housing to contain said pressure switch, said digital message device, and said transmitting device;

(g) a matching radio frequency receiving device; and (h) a portable housing to contain said receiving device, said housing also containing an audio transducer that creates an audible warning sound activated by said receiving device;

whereby said air cushion, said air tube, said electronic circuit, said digital recordable message device, said radio frequency transmitting device, and said housing are attached together and are adapted for transportation as a single unit.

2. Seat Operated Switch and Warning System as claimed in claim 1 wherein when a person sits on said air cushion the pressure caused by the weight of the person causes said air pressure switch not to activate, but when said person exits off of said air cushion said air pressure switch causes said recorded message to play and causes said transmitter to send a signal to said receiver causing said audio transducer to produce a warning sound.

3. A seat operated switch and warning system comprising:

(a) an air cushion;

(b) an air tube leading from said air cushion to an air pressure switch;

(c) an electronic circuit to activate devices when a reduction in air pressure is sensed;

(d) a digital recordable message device;

(e) a radio frequency transmitting device;

(f) a housing to contain said pressure switch, said digital message device, and said transmitting device;

(g) a matching radio frequency receiving device;

(h) a portable housing to contain said receiving device, said housing also containing an audio transducer that creates an audible warning sound activated by said receiving device; and (i) an air valve attached to said air cushion, said air valve including means for inflating said air cushion and means for deflating said air cushion.

4. A seat operated switch and warning system comprising:

(a) an air cushion;

(b) an air tube leading from said air cushion to an air pressure switch;

(c) an electronic circuit to activate devices when a reduction in air pressure is sensed;

(d) a digital recordable message device;

(e) a radio frequency transmitting device;

(f) a housing for containing said pressure switch, said digital message device, and said transmitting device;

(g) a matching radio frequency receiving device;

(h) a portable housing for containing said receiving device, said housing also containing an audio transducer that creates an audible warning sound activated by said receiving device;

(i) an air valve attached to said air cushion, said air valve including means for inflating said air cushion and means for deflating said air cushion; and (j) means for recording a message attached to said housing for containing said pressure switch, said digital message device, and said transmitting device, said means for recording a message adapted for recording an announcement that is specific to the needs of a patient sitting on said air cushion.

5. The seat operated switch and warning system of claim 4 wherein said digital recordable message device includes means adapted for playing back to said patient said announcement.

6. The seat operated switch and warning system of claim 5 wherein said announcement includes a recitation of said patient's name.

* * * * *